US005640135A

United States Patent [19]

Hall et al.

[11] Patent Number: 5,640,135

[45] Date of Patent: Jun. 17, 1997

[54] SECTIONAL FERRITE CORE CONSTRUCTION FOR MECHANICAL STRESS RELIEF IN INDUCTIVE CHARGING SYSTEMS

[75] Inventors: John T. Hall, Woodland Hills; Herbert J. Tanzer, Topanga; George Woody, Redondo Beach, all of Calif.

[73] Assignee: Delco Electronics Corp., Kokomo, Ind.

[21] Appl. No.: 238,069

[22] Filed: Apr. 29, 1994

[51] Int. Cl.[6] ..... H01F 27/24; H01F 27/30

[52] U.S. Cl. ..... 336/212; 336/83; 336/233; 336/234; 336/DIG. 2

[58] Field of Search ..... 336/233, 234, 336/212, 200, 83, DIG. 2, 119, 210

[56] References Cited

U.S. PATENT DOCUMENTS

| | | | |
|---|---|---|---|
| 2,483,815 | 10/1949 | Easton | 336/DIG. 2 |
| 2,962,679 | 11/1960 | Stratton | 336/234 |
| 3,530,499 | 9/1970 | Schroeder | 336/DIG. 2 |
| 3,534,310 | 10/1970 | Delissier | 336/DIG. 2 |
| 3,535,200 | 10/1970 | Bergstom | 336/233 |
| 5,175,525 | 12/1992 | Smith | 336/232 |
| 5,216,402 | 6/1993 | Carosa | 336/DIG. 2 |
| 5,434,493 | 7/1995 | Woody et al. | 336/DIG. 2 |

FOREIGN PATENT DOCUMENTS

| | | | |
|---|---|---|---|
| 2252208 | 7/1992 | United Kingdom | 336/200 |

*Primary Examiner*—Thomas J. Kozma
*Attorney, Agent, or Firm*—Mark A. Navarre

[57] ABSTRACT

An inductive charging coupler for use in an inductive charging system that minimizes damage thereto caused by shock. The charging coupler comprises a housing, and a magnetic core disposed in the housing that is comprised of a plurality of sections. A primary winding is disposed around the magnetic core, A current conductor is coupled to the primary winding for coupling current thereto. By employing smaller sections of ferrite material to form the magnetic core, there is less potential for encountering broad differences in the crystal structure of the ferrite material. These structural differences can cause the ferrite material to be more prone to crack or shatter under stress conditions, such as if the coupler is dropped during use. Also smaller ferrite pieces are lighter than a single piece of ferrite material, which causes lower distributed loads due to a shock. In addition, smaller ferrite pieces allow more surface area contact with housing components or adhesives used to secure the core in the coupler and help dampen shock loads.

1 Claim, 2 Drawing Sheets

SECTIONAL FERRITE CORE CONSTRUCTION FOR MECHANICAL STRESS RELIEF IN INDUCTIVE CHARGING SYSTEMS

BACKGROUND

The present invention relates generally to inductive charging systems, and more particularly, to an inductively coupled probe employed in such inductive charging systems that incorporates a ferrite core structure that minimizes damage thereto caused by shock.

The assignee of the present invention manufactures inductive charging systems for use in electric vehicles, and the like. The inductive charging systems employ an inductive coupling probe that forms the primary of the charging system, and a charge port on the electric vehicle that forms the secondary of the charging system. The inductive coupled probe has ferrite embedded in the probe that is used to to complete the magnetic path between the charging system and the battery of the electric vehicle. Details of the probe are described in U.S. Pat. No. 5,434,393 entitled "Fixed Core Inductive Charger" assigned to the assignee of the present invention. The ferrite used in the probe is a very fragile material. The probe described in this patent application is inserted and removed from the charge port in the electric vehicle during operation. It is desirable to provide for a means for preventing damage to the embedded ferrite due to shock during the insertion and removal process.

Therefore, it is an objective of the present invention to provide for an inductively coupled probe that incorporates a means for preventing damage to the embedded ferrite due to shock.

SUMMARY OF THE INVENTION

The present invention provides for mechanical stress relief in a ferrite core or puck used in charging couplers of inductively coupled chargers. Mechanical stress relief is required in such probes because ferrite is a relatively fragile ceramic material, is prone to breakage, and will potentially shatter if the charging coupler is dropped during use. The present invention is particularly well-suited for use with inductive coupled battery chargers employed to charge electric vehicles.

More particularly, the present invention comprises an inductive charging coupler for use in an inductive charging system that minimizes damage thereto caused by shock. The charging coupler comprises a housing, and a magnetic core disposed in the housing that is comprised of a plurality of sections. A primary winding is disposed around the magnetic core, A current conductor is coupled to the primary winding for coupling current thereto.

By employing smaller sections of ferrite material to form the magnetic core, there is less potential for encountering broad differences in the crystal structure of the ferrite material. These structural differences can cause the ferrite material to be more prone to crack or shatter under stress conditions, such as when the coupler is dropped during use. Also smaller ferrite pieces are lighter than a single piece of ferrite material, which causes lower distributed loads due to a shock. In addition, smaller ferrite pieces allow more surface area contact with housing components or adhesives used to secure the ferrite core in the coupler and help dampen shock loads.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
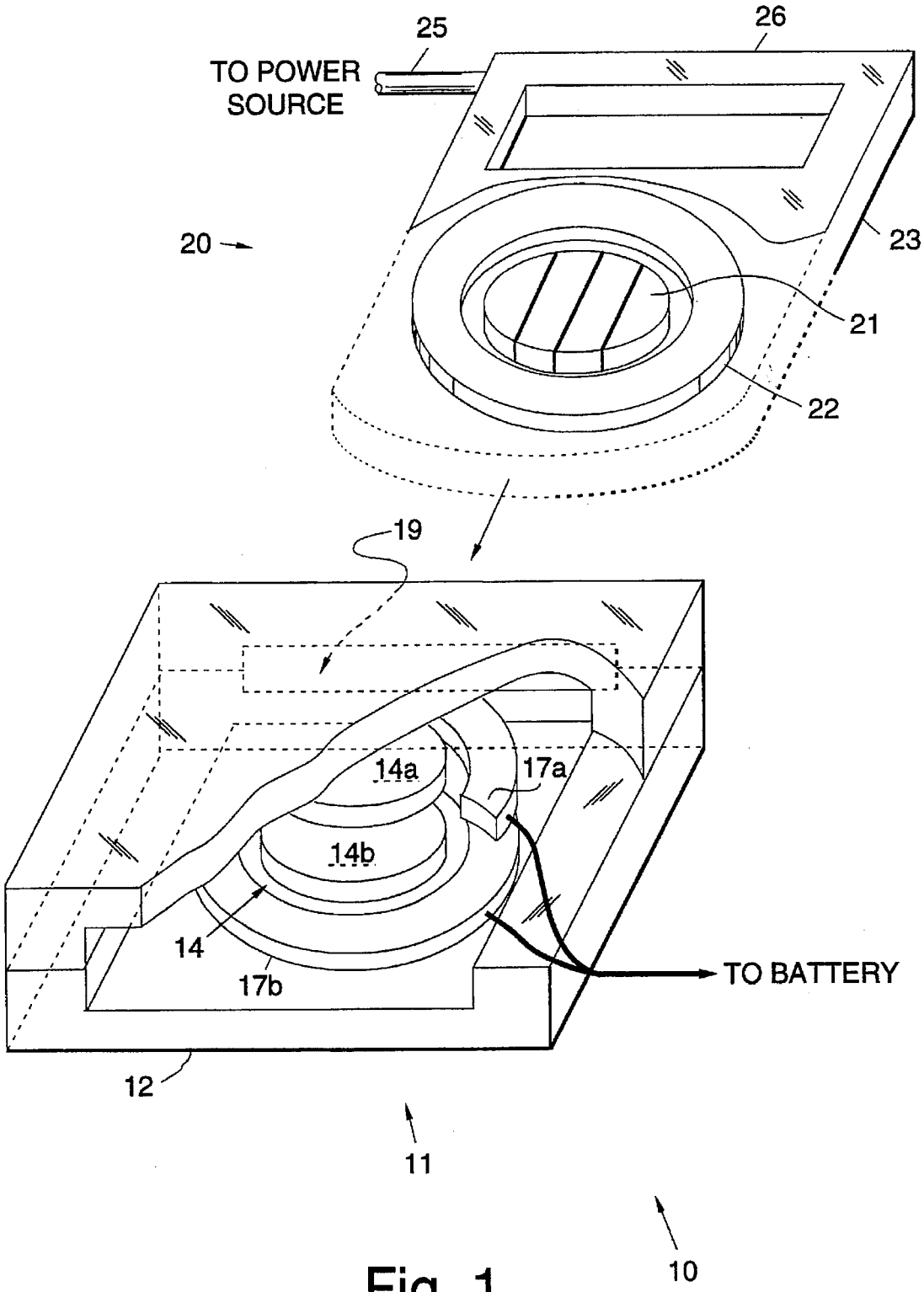
FIG. 1 illustrates a perspective view of of charging apparatus employing a charging coupler having a sectioned core in accordance with the principles of the present invention.

Referring to the drawing figures, FIG. 1 illustrates a partially broken away perspective view of charging apparatus 10 employing a probe 20 or charging coupler 20 in accordance with the principles of the present invention. The charging apparatus 10 is comprised of a charge port 11 and the charging coupler 20. The charge port 11 includes a housing 12 having an opening 19 into which the charging coupler 20 is inserted. The charge port 11 is coupled to a battery (not shown) of an electric vehicle, for example, in which it is housed. The charging coupler 20 is comprised of a housing 23 having a handle 26, a center magnetic core 21 or "puck" 21, that may be comprised of ferrite, for example. A primary winding 22 is disposed around the center magnetic core 21. A conductor 25, or other current carrying means 25, is coupled to the primary winding 22 and to an external power source (not shown) for coupling energy to the charging coupler 20. The charging coupler 20 is designed to be inserted into the opening 19 of the charge port 11 in order to couple current to the battery from the external power source.

Details regarding the construction of the charging apparatus 10, charge port 11, and charging coupler 20 may be found in U.S. Pat. No. 5,434,393, entitled "Fixed Core Inductive Charger" assigned to the assignee of the present invention. The present invention is an improvement to this invention and charging couplers used in similar charging apparatus 10, and focuses on the construction of the charging coupler 20 and puck 21.

In general, the charge port 11 includes two magnetic core halves **14*a*, 14*b*, that may be comprised of ferrite, for example, that together form a secondary core 14. The magnetic core halves 14*a*, 14*b* may be formed in the shape of an "E-core", for example. First and second secondary windings 17*a*, 17*b* are disposed adjacent each of the magnetic core halves 14*a*, 14*b*. The opening 19 is formed between the respective first and second magnetic core halves 14*a*, 14*b*** that provides for a predetermined spacing between adjacent surfaces thereof.

The coupler 20 is comprised of a center magnetic core 21 that may be comprised of ferrite, for example, around which the primary winding 22 is disposed. The center magnetic core 21 and primary winding 22 are enclosed in the housing 23 which may be comprised of plastic, for example, that is in the shape of a wand, or has the handle 26 on it that allows a user to grip it. The center magnetic core 21 in the coupler 20, when inserted into the opening 19 in the charge port 11, forms part of a completed magnetic circuit, and more particularly, provides the center portion of the E-core magnetic design that couples center portions of the magnetic core halves 14*a*, 14*b* together.

The center magnetic core 21 may be configured in a round, square, rectangular, or hexagonal shape, for example, depending upon the geometry of the magnetics design. Such shapes are illustrated in FIGS. 2–7. In addition, the core geometry may have an "EE" core configuration, an "EP" core configuration, or an "RS" core configuration, for example. Furthermore, the primary and secondary windings 17*a*, 17*b*, 22 may be formed as circular helix windings made of foil, a multiple layer winding, or a flat spiral winding made of foil or wire having a single layer, for example. The coupler 20 may use a round core 21 having a circular winding 22 disposed therearound, or may use a square or rectangular core 21 having a correspondingly square or rectangular winding 22 disposed around it, for example. The secondary core 14, comprising the magnetic core halves 14*a*, 14*b*, has a fixed, nonmoving configuration. The coupler 20, comprising the center magnetic core 21 and primary winding 22, is insertable into the secondary core 14, and the center magnetic core 21 in conjunction with the magnetic core halves 14*a*, 14*b* of the secondary core 14 form a complete magnetic circuit.

Figure 2:
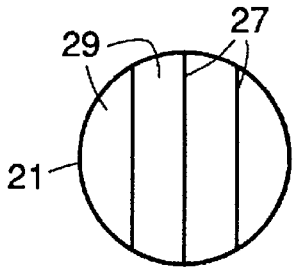
FIG. 2 illustrates a top view of a first embodiment of the sectioned core that may be used in the charging coupler of FIG. 1.
Figure 3:
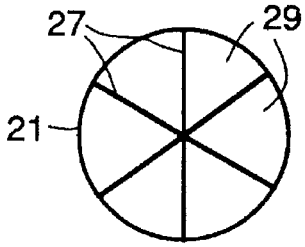
FIG. 3 illustrates a top view of a second embodiment of the sectioned core that may be used in the charging coupler of FIG. 1.
Figure 4:
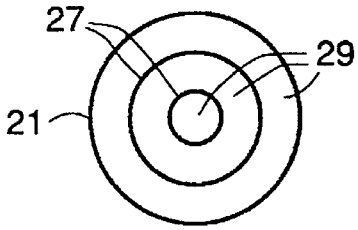
FIG. 4 illustrates a top view of a third embodiment of the sectioned core that may be used in the charging coupler of FIG. 1.
Figure 5:
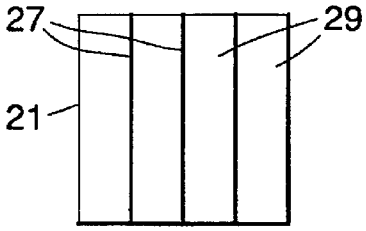
FIGS. 5–7 illustrate square, rectangular, and hexagonal shaped cores employing the principles of the present invention that may be employed in the charging coupler of FIG. 1.
Figure 6:
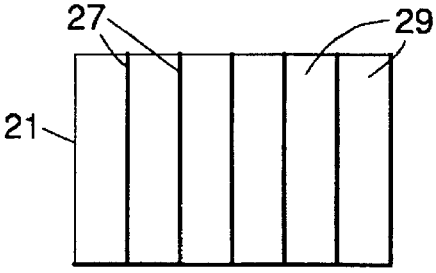
Figure 7:
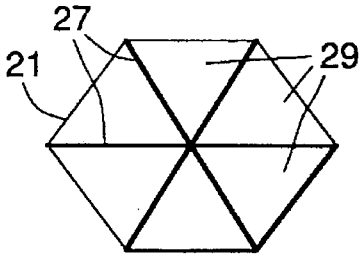

The improvements provided by the present invention are as follows. Mechanical stress relief is provided by dividing the center ferrite core 21 into relatively small sections. A plurality of different embodiments of the present invention that provide for such mechanical stress relief are shown in FIG. 2–7. FIG. 2 shows a circular core 21 having four sections 29 formed by split lines 27. FIG. 3 shows a circular core 21 having six pie-shaped sections 29 formed by split lines 27. FIG. 4 shows a circular core 21 having three circular sections 29 formed by split lines 27. FIGS. 5–7 illustrate square, rectangular, and hexagonal shaped cores 21 that may be employed in the charging coupler 20.

By employing smaller sections of ferrite material to form the core 21, there is less potential for encountering broad differences in the crystal structure of the ferrite material. These structural differences can cause the ferrite material to be more prone to crack or shatter under stress conditions, such as when the coupler 20 or probe 20 is dropped during use. Also smaller ferrite pieces are lighter than a single piece of ferrite material, which causes lower distributed loads due to a shock. In addition, smaller ferrite pieces allow more surface area contact with plastic housing components or adhesives used to secure the ferrite core 21 in the coupler 20 and help dampen shock loads. The magnetic inductance of the probe 20 is not reduced due to the sectioned ferrite pieces of the core 21. This is because the magnetic flux flows in a direction parallel to an axis along the thickness dimension of ferrite core 21. The split lines 27 require only a small cross sectional area facing the direction of an inductance path of the charging coupler 20.

Thus there has been described a new and improved inductive coupled probe for use in inductive charging systems that incorporates a ferrite core structure that minimizes damage thereto caused by shock. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. An inductive charging coupler for use in an inductive charging system that minimizes damage thereto caused by shock, said charging coupler comprising:

a housing;

a ferrite puck disposed in the housing and having a thickness dimension along an axis that coincides with a desired direction of magnetic flux through said puck, said puck being divided into a plurality of sections along: said thickness dimension, adjacent sections of said puck being secured to one another with adhesive so as to distribute loads experienced by the puck due to shock, thereby minimizing damage to the coupler from such shock;

a primary winding disposed around the ferrite puck; and means for coupling current to the primary winding.

* * * * *